US007600300B2

(12) United States Patent
Russell et al.

(10) Patent No.: US 7,600,300 B2
(45) Date of Patent: Oct. 13, 2009

(54) SLIDER ZIPPER WITH WIDE TRACK PROFILE FOR POWDER AND GRANULATED PRODUCTS

(75) Inventors: Glyn Russell, New City, NY (US); Ernesto Pitargue, Carmel, NY (US); Edward Babcock, III, Congers, NY (US)

(73) Assignee: Illinois Tool Works Inc., Glenview, IL (US)

( * ) Notice: Subject to any disclaimer, the term of this patent is extended or adjusted under 35 U.S.C. 154(b) by 438 days.

(21) Appl. No.: 11/657,320

(22) Filed: Jan. 24, 2007

(65) Prior Publication Data

US 2008/0172846 A1 Jul. 24, 2008

(51) Int. Cl.

| | |
|---|---|
| ***A44B 19/16*** | (2006.01) |
| ***A44B 19/24*** | (2006.01) |
| ***A44B 19/26*** | (2006.01) |
| *B65D 33/16* | (2006.01) |

(52) U.S. Cl. ..... 24/400; 24/585.12; 24/30.5 R; 383/64

(58) Field of Classification Search ..... None
See application file for complete search history.

(56) References Cited

U.S. PATENT DOCUMENTS

| | | | | |
|---|---|---|---|---|
| 5,953,796 | A | 9/1999 | McMahon et al. | |
| 6,014,795 | A | 1/2000 | McMahon et al. | |
| 6,047,450 | A | 4/2000 | Machacek | |
| 6,112,374 | A | 9/2000 | Van Erden | |
| 6,182,337 | B1 | 2/2001 | Machacek | |
| 6,874,937 | B2 * | 4/2005 | Ausnit | 383/64 |
| 7,017,241 | B2 * | 3/2006 | Bentsen | 24/400 |
| 7,025,503 | B2 * | 4/2006 | Plourde | 383/64 |
| 7,189,001 | B2 * | 3/2007 | Gerrits | 383/63 |
| 2003/0228076 | A1 * | 12/2003 | Plourde et al. | 383/64 |
| 2004/0037479 | A1 * | 2/2004 | Bentsen | 383/64 |
| 2006/0029301 | A1 | 2/2006 | Schreiter | |

* cited by examiner

*Primary Examiner*—Robert J Sandy
(74) *Attorney, Agent, or Firm*—Day Pitney LLP

(57) ABSTRACT

The present disclosure relates to a slider zipper including first and second interlocking profiles with female and male interlocking elements. The female interlocking element is formed from two extending arms which are sufficiently spaced so as to receive the male interlocking element while maintaining an open space therebetween in order to accommodate powdered or granular products between the interlocking profiles. The first and second interlocking profiles further include complementary fulcrum elements to allow the slider walls to pivot the interlocking profiles into and out of engagement. The slider further includes interior surfaces which engage retaining shoulders of the interlocking profiles to displace the interlocking profiles with respect to one another.

20 Claims, 4 Drawing Sheets

SLIDER ZIPPER WITH WIDE TRACK PROFILE FOR POWDER AND GRANULATED PRODUCTS

BACKGROUND OF THE INVENTION

1. Field of the Invention

The present invention relates to a zipper for a reclosable package or bag, including a wide opening on the female profile and two separated hooks on the male profile in order to provide a space to accommodate granulated products between the profiles when the zipper is closed.

2. Description of the Prior Art

In the prior art, slider zippers for reclosable packages or bags are well-known. Such references as U.S. Pat. No. 6,112,374 entitled "Zipper for Slider Package", issued on Sep. 5, 2000 to Van Erden; U.S. Pat. No. 6,014,795 entitled "Slide Zipper Assembly", issued on Jan. 18, 2000 to McMahon et al.; and U.S. Pat. No. 5,953,796 issued on Sep. 21, 1999 to McMahon et al. disclose slider zippers wherein a separator finger is inserted between the zipper profiles in order to separate the zipper profiles when the slider is moved in the opening direction. While this has proven very satisfactory, further improvements have been sought in order to improve the sealing capability of the slider and to simplify the insertion of the slider onto the profiles during the manufacturing process.

In this regard, U.S. Pat. Nos. 6,047,450 issued on Apr. 11, 2000 and 6,182,337 issued on Feb. 6, 2001, both to Machacek and entitled "Slide Zipper Assembly", disclose a slider zipper wherein the profiles are caused to pivot with respect to each other, thereby interlocking or separating, depending upon the direction of the movement of the slider, in response to changes in the interior contours of the slider. Therefore, the need for a separator finger is eliminated thereby allowing the slider to be inserted onto the zipper profiles without inserting a separator finger therebetween. While this zipper has been highly satisfactory, the profiles are very close fitting and further improvements are sought with respect to accommodating powdered or granular products between the profiles, particularly when the zipper is re-closed by the consumer after initial opening.

OBJECTS AND SUMMARY OF THE INVENTION

It is therefore an object of the present invention to provide a zipper for a reclosable package or bag, wherein the zipper maintains a reliable sealing capability and the zipper insertion process is simplified during the initial manufacturing of the package or bag.

It is therefore a further object of the present invention to provide a zipper for a reclosable package or bag, wherein the zipper can accommodate powdered or granular products between the profiles when the zipper is closed, particularly when the zipper is re-closed by the consumer after initial opening.

These and other objects are attained by providing a slider zipper wherein the zipper profiles and slider are shaped so that the zipper profiles are manipulated to interlock or separate by action of the slider walls on the outer surfaces of the profiles without the need for a separator finger to be inserted between the profiles. Additionally, the female profile includes a wide opening which receives two separated hooks from the male profile. This wide opening in the female profile, along with the separation between the hooks in the male profile, provides a space for the powders or granulated products, such as sugar, to be accommodated when the zipper is closed, particularly when it is re-closed by the consumer.

BRIEF DESCRIPTION OF THE DRAWINGS

Further objects and advantages of the invention will become apparent from the following description and from the accompanying drawings, wherein.

DETAILED DESCRIPTION OF THE PREFERRED EMBODIMENT

Figure 1:
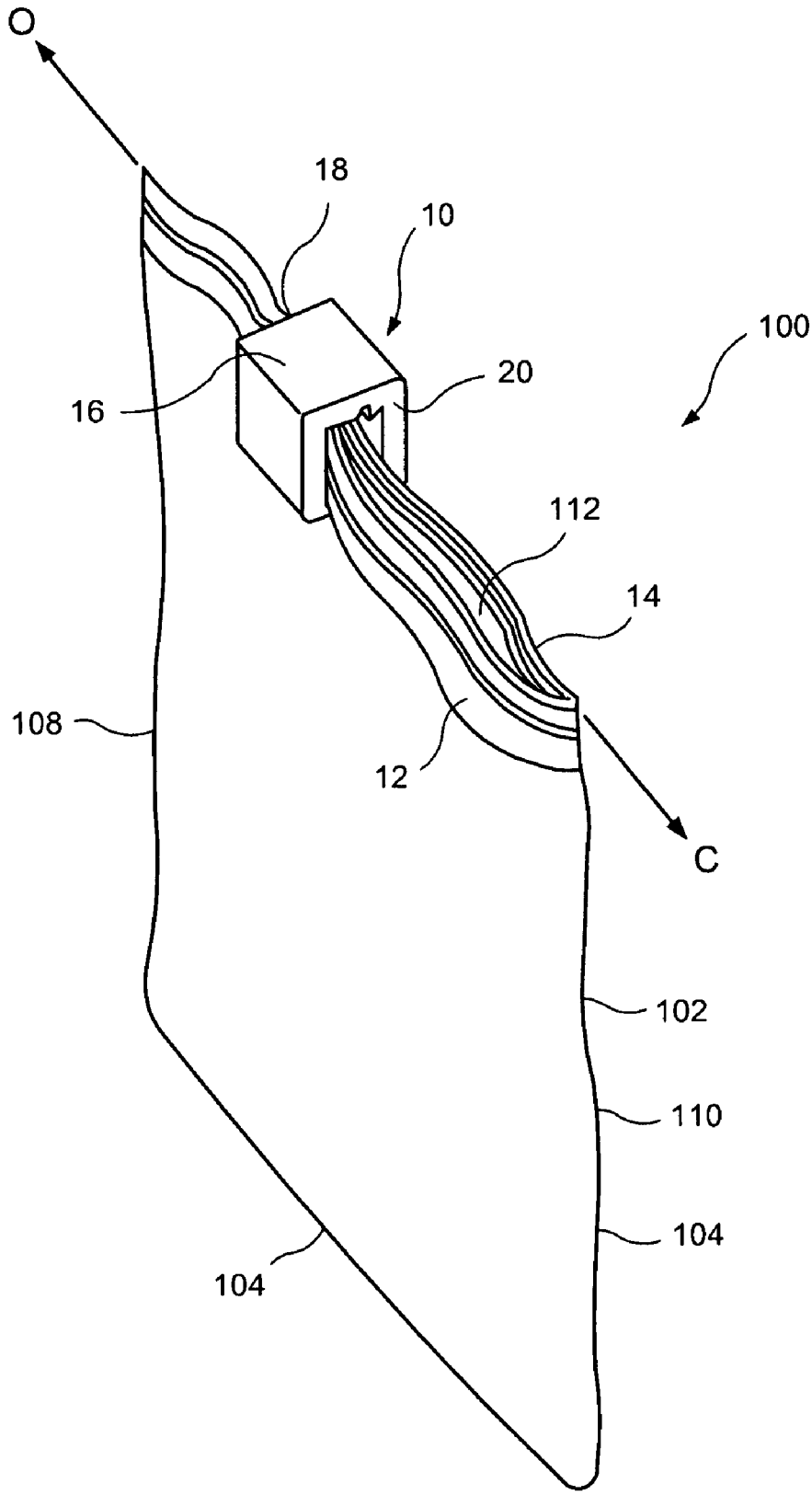
FIG. 1 is a perspective view of a typical reclosable package or bag incorporating the slider zipper of the present invention.

Referring now to the drawings in detail wherein like numerals refer to like elements throughout the several views, one sees that FIG. 1 is a perspective view of a typical reclosable package or bag 100 incorporating the slider zipper 10 of the present invention. Reclosable package or bag 100 includes front and rear walls 102, 104 formed from sheets of polymeric web or film, joined by a bottom seal 106 and side seals 108, 110 thereby forming a mouth 112. In some embodiments, one of seals 106, 108, 110 may be replaced by a fold thereby allowing front and rear walls 102, 104 to be formed from a single sheet of polymeric web or film. Zipper 10 includes first and second interlocking zipper profiles 12, 14 joined to respective front and rear walls 102, 104 immediately adjacent to mouth 116 thereby making package or bag 100 reclosable. Slider 16 is mounted on first and second interlocking zipper profiles 12, 14 and operates to separate interlocking zipper profiles 12, 14 when moved in an opening direction (illustrated as direction "o") and to interlock zipper profiles 12, 14 when moved in a closing direction (illustrated as direction "c"). Slider 16 includes a closing end 18 which is illustrated in more detail in FIGS. 2 and 4 and an opening end 20 which is illustrated in more detail in FIGS. 3 and 5.

Figure 2:
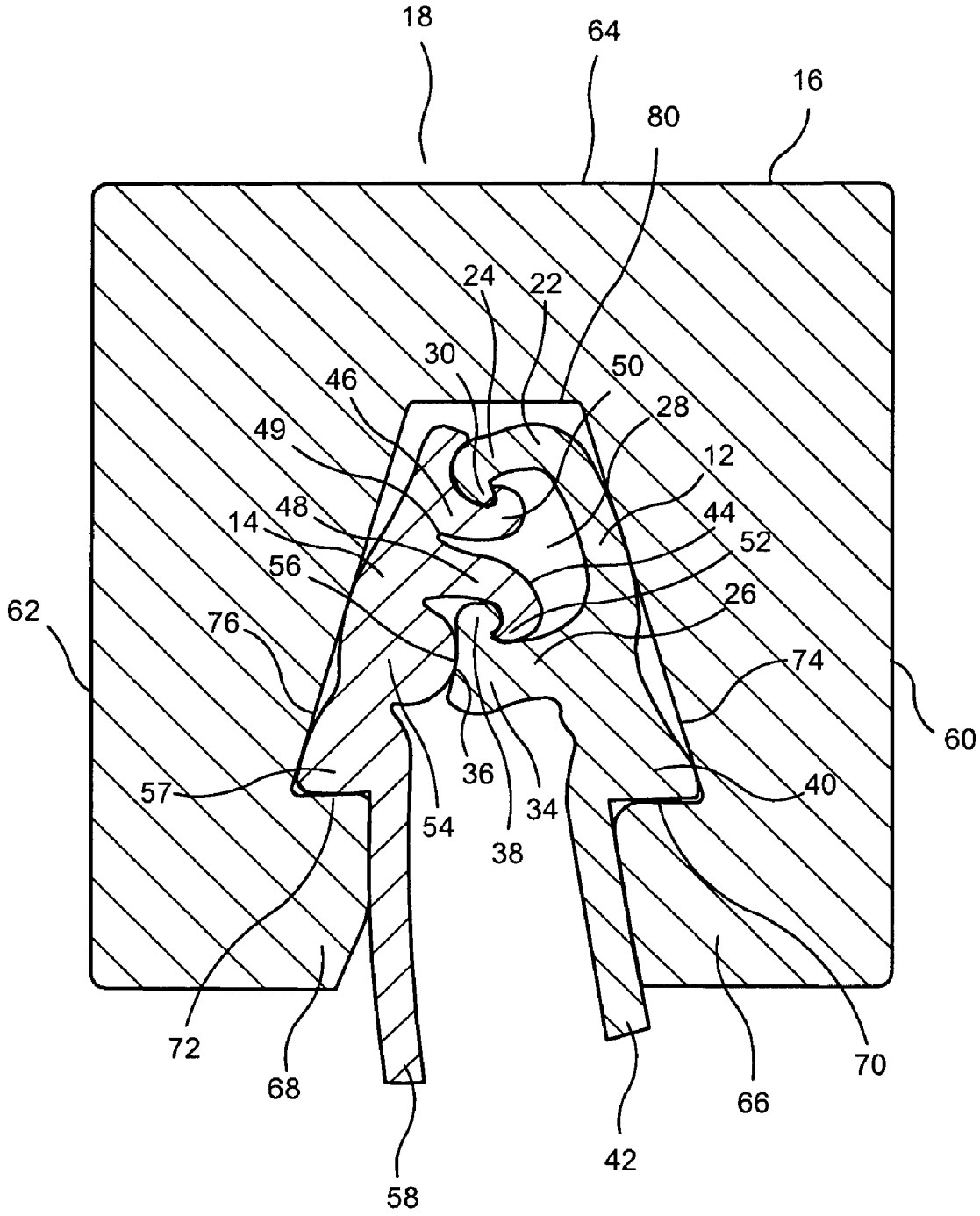
FIG. 2 is a plan view of the closing end of the slider along with a cross-sectional view of the zipper profiles of the slider zipper of the present invention.

FIG. 2 illustrates the closing end 18 of slider 16 as well as a cross-sectional view of the interlocked first and second zipper profiles 12, 14. First zipper profile 12 includes female interlocking element 22 formed from upper female (or outer) arm 24 and lower female (or outer) arm 26 with space 28 therebetween. Space 28 receives male interlocking element 44 and further accommodates the entry of powdered or granular products therein when zipper 10 is in the closed configuration. Upper and lower inwardly extending detent hooks 30, 32 are formed on the distal ends of upper and lower female arms 24, 26, respectively. The distal end of lower female arm 26 further includes an enlarged portion 34 with a concave shaped fulcrum member 36. First zipper profile 12 further includes first retaining shoulder 40 and first lower flange 42 for joining to front wall 102.

Second zipper profile 14 includes male interlocking element 44 formed from upper male (or inner) arm 46 and lower male (or inner) arm 48 with space 49 formed therebetween. In the interlocked configuration of FIG. 2, spaces 28 and 49 accommodate the entry of powdered or granular products therein. Upper and lower outwardly extending detent hooks 50, 52 are formed on the distal ends of upper and lower male arms 46, 48, respectively. Additionally, bulbous portion 54 is formed immediately beneath lower male arm 48. Convex shaped fulcrum member 56 is formed on bulbous portion 54 and is engaged against concave shaped fulcrum member 36 thereby forming a pivoting relationship. Second zipper profile further includes second retaining shoulder 56 and second lower flange 58 for joining to rear wall 104.

Figure 4:
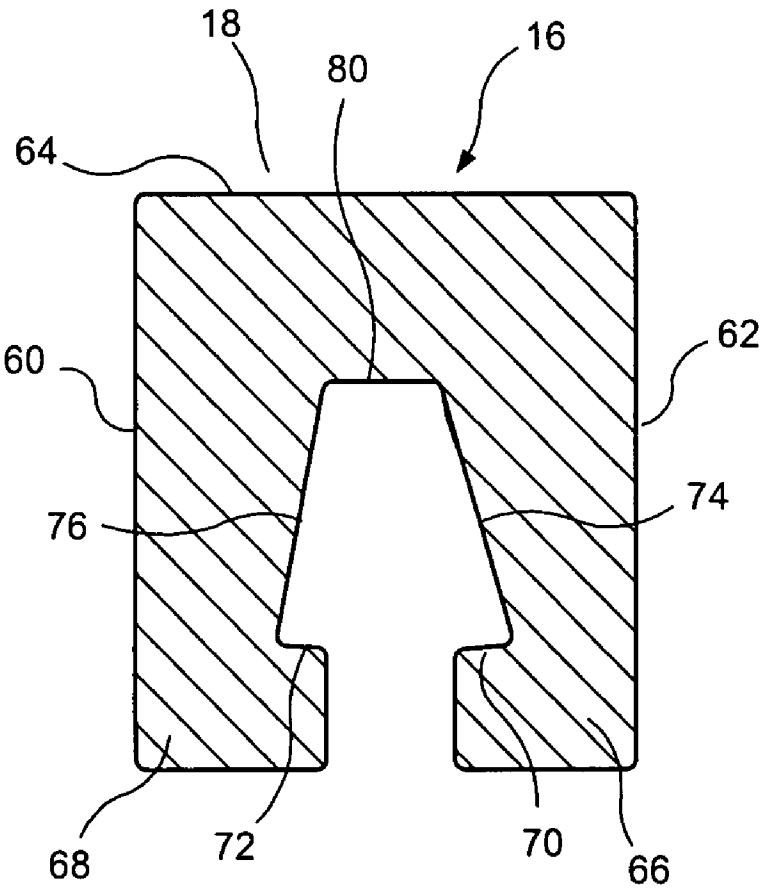
FIG. 4 is a cross-sectional view of the closing end of the slider of the slider zipper of the present invention.

Slider 16 includes first and second exterior side walls 60, 62 and top surface 64. The lower ends of first and second exterior side walls include respective first and second inwardly extending slider flanges 66, 68 which further form first and second interior lower surfaces 70, 72 for engaging first and second retaining shoulders 40, 56. As shown in FIGS. 2 and 4, the interior passageway of the closing end 18 of slider 16 has a roughly A-shaped cross section with first and second inclined interior side walls 74, 76, upper interior horizontal surface 80 and first and second interior lower surfaces 70, 72. At the closing end 18 of slider 16 as illustrated in FIG. 2, first and second inclined interior side walls 74, 76 abut respective first and second interlocking zipper profiles 12, 14 and first and second retaining shoulders 40, 56 are at the same level. This configuration aligns the first and second interlocking zipper profiles 12, 14 and urges upper and lower male arms 46, 48 into the space 28 between upper and lower female arms 24, 26 so that upper and lower inwardly extending detent hooks 30, 32 detent engage with respective upper and lower outwardly extending detent hooks 50, 52.

Figure 3:
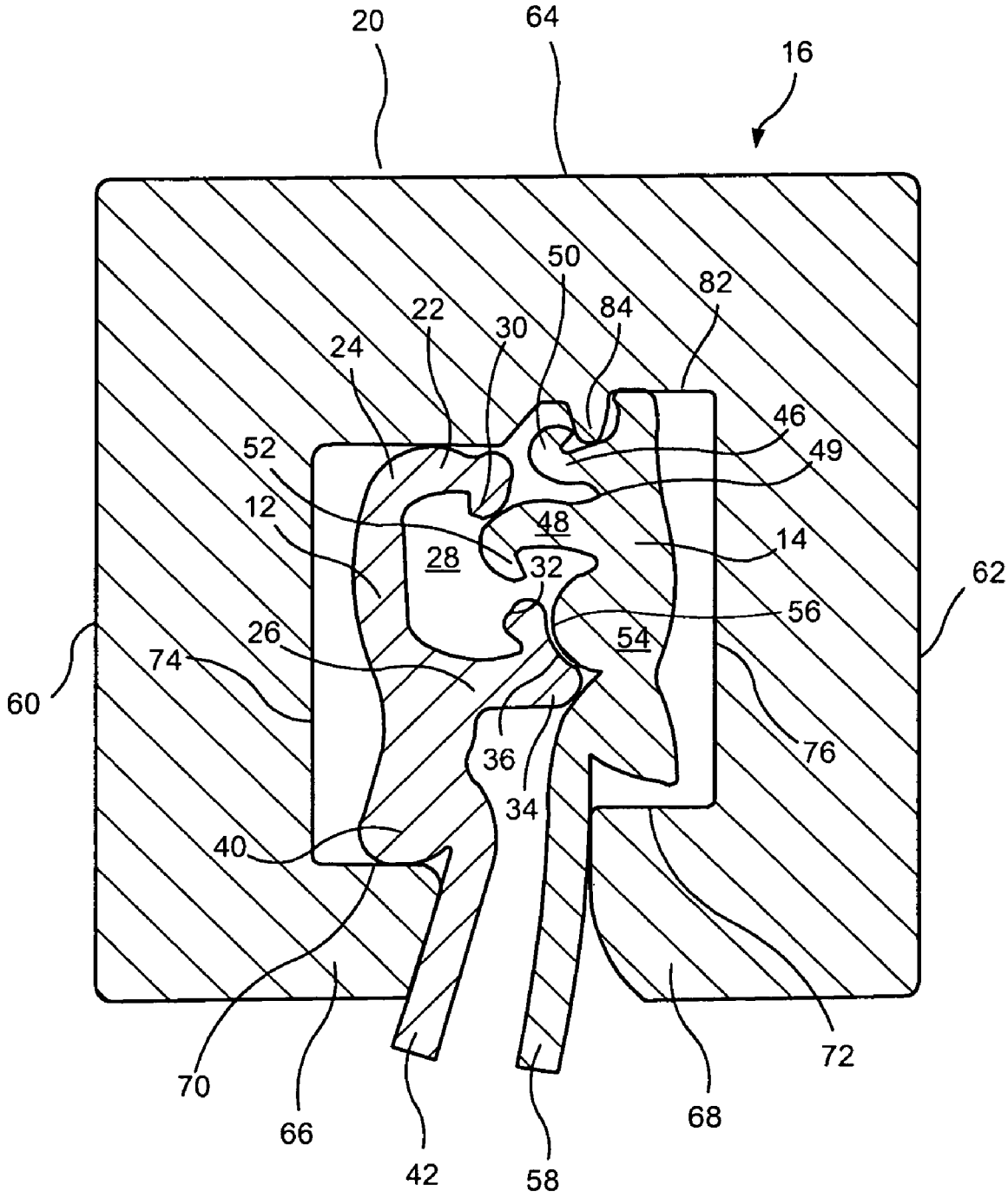
FIG. 3 is a plan view of the opening end of the slider along with a cross-sectional view of the zipper profiles of the slider zipper of the present invention.
Figure 5:
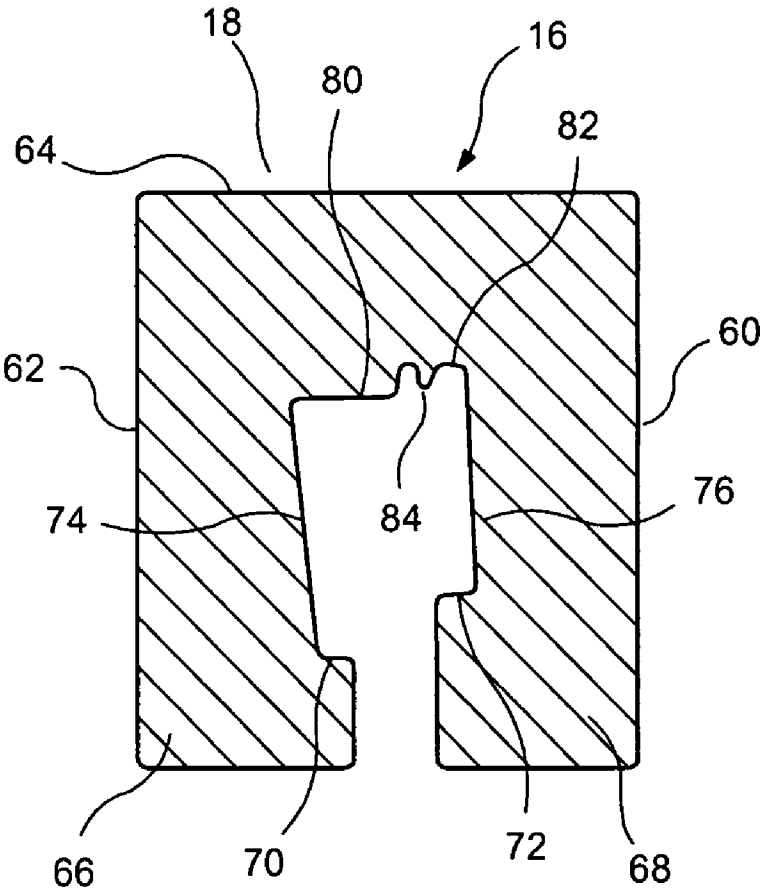
FIG. 5 is a cross-sectional view along the opening end of the slider of the slider zipper of the present invention.

The opening end 20 of slider 16 is illustrated in FIGS. 3 and 5. First and second interior side walls 74, 76 are formed roughly parallel to each other. Additionally, second interior lower surface 72 is formed at a higher level than is first interior lower surface 70. Cavity 82 is formed on the upper interior horizontal surface 80 to accommodate the upward displacement of second zipper profile 14 due to the upward offset of second interior lower surface 72 with respect to first interior lower surface 70. Cavity 82 includes guiding protrusion 84 for engaging upper male arm 46 immediately adjacent to upper outwardly extending detent hook 50. The parallel configuration and spacing of side walls 74, 76 at the opening end 20 of slider 16 urges or squeezes the lower portions of first and second interlocking profiles 12, 14 (that is, the portions of interlocking profiles 12, 14 which are on the opposite side of the fulcrum members 36, 56 from the interlocking elements 22, 44) together thereby causing first and second interlocking profiles 12, 14 to pivot with respect to each other about the pivoting configuration formed by concave and convex shaped fulcrum members 36, 56. This pivoting pulls upper male arm 46 out of engagement with upper female arm 24. Similarly, the upward displacement (that is, perpendicular to the direction of movement of slider 16 and away from package or bag 100) of second zipper profile 14 with respect to first zipper profile 12 caused by the urging of second lower interior surface 72 causes lower male arm 48 to release engagement with lower female arm 26.

In this manner, many embodiments of zipper 10 can function without the need for a separator finger in the slider.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A zipper for a reclosable package or bag, comprising:

a first profile and a second profile;

the first profile including a first interlocking element and a first fulcrum member;

the second profile including a second interlocking element and a second fulcrum member;

the first interlocking element including a first space for receiving the second interlocking element therein and interlocking therewith;

the second interlocking element including a first inner arm and a second inner arm, with a second space formed between the first and second arms; and the first fulcrum member abutting the second fulcrum member thereby forming a pivoting relationship between a first position and a second position, wherein the first and second interlocking elements are in interlocking relationship in the first position and wherein the first and second interlocking elements are free of an interlocking relationship in the second position.

2. The zipper of claim 1 wherein the first interlocking element is a female element and the second interlocking element is a male element, wherein the female element includes first and second outer arms for capturing the first and second inner arms therein.

3. The zipper of claim 2 wherein the first space and the second space join in the first position, and granulated or powder products may be accommodated therein.

4. The zipper of claim 3 wherein the first and second outer arms include respective first and second inwardly extending detent hooks on distal ends thereof.

5. The zipper of claim 4 wherein the first and second inner arms include respective first and second outwardly extending detent hooks on distal ends thereof.

6. The zipper of claim 5 wherein, in the first position, the first and second inwardly extending detent hooks are engaged with respective first and second outwardly extending detent hooks.

7. The zipper of claim 6 wherein the first fulcrum member is formed on one of the first and second outer arms.

8. The zipper of claim 7 wherein the first fulcrum member includes a concave section.

9. The zipper of claim 8 wherein the second fulcrum member is formed adjacent to the second interlocking element.

10. The zipper of claim 9 wherein the second fulcrum member includes a convex section for engaging the concave section of the first fulcrum member, thereby forming a pivoting relationship.

11. A zipper for a reclosable package or bag, comprising:

a first profile and a second profile;

the first profile including a first interlocking element and a first fulcrum member;

the second profile including a second interlocking element and a second fulcrum member;

the first interlocking element including a first space for receiving the second interlocking element therein and interlocking therewith;

the second interlocking element including a first inner arm and a second inner arm, with a second space formed between the first and second arms;

the first fulcrum member abutting the second fulcrum member thereby forming a pivoting relationship between a first position and a second position, wherein the first and second interlocking elements are in interlocking relationship in the first position and wherein the first and second interlocking elements are free of an interlocking relationship in the second position; and a slider for interlocking the first and second profiles when moved in a closing direction and for separating the first and second profiles when moved in an opening direction, the slider including an opening end and a closing end, wherein interior contours of the slider at the closing end urge the first and second profiles into the first position and wherein interior contours of the slider at the opening end urge the first and second profiles into the second position.

12. The zipper of claim 11 wherein the interior contours of the slider include first and second interior walls, the first and second interior walls being configured in the closing end to pivot the first and second profiles about the first and second fulcrum members to the first position, and the first and second interior walls being configured in the opening end to pivot the first and second profiles about the first and second fulcrum members to the second position.

13. The zipper of claim 12 wherein the first and second interior walls squeeze the first and second profiles together in the opening end on a side of the first and second fulcrum members opposite to that of the first and second interlocking members, thereby causing the first and second interlocking members to separate.

14. The zipper of claim 13 wherein the first and second interior walls include inwardly extending flange portions, and wherein the inwardly extending flange portions in the opening end cause relative movement of one of the first and second profiles perpendicular to the direction of movement of the slider.

15. The zipper of claim 14 wherein the first interlocking element is a female element and the second interlocking element is a male element, wherein the female element includes first and second outer arms for capturing the first and second inner arms therein.

16. The zipper of claim 15 wherein the first space and the second space join in the first position, and granulated or powder products may be accommodated therein.

17. The zipper of claim 16 wherein the first and second outer arms include respective first and second inwardly extending detent hooks on distal ends thereof, wherein the first and second inner arms include respective first and second outwardly extending detent hooks on distal ends thereof, and wherein, in the first position, the first and second inwardly extending detent hooks are engaged with respective first and second outwardly extending detent hooks.

18. The zipper of claim 17 wherein the first fulcrum member is formed on one of the first and second outer arms and wherein the second fulcrum member is formed adjacent to the second interlocking element.

19. The zipper of claim 18 wherein the first fulcrum member includes a concave section.

20. The zipper of claim 19 wherein the second fulcrum member includes a convex section for engaging the concave section of the first fulcrum member, thereby forming a pivoting relationship.

* * * * *